US009901154B2

(12) United States Patent
Cho

(10) Patent No.: US 9,901,154 B2
(45) Date of Patent: Feb. 27, 2018

(54) HAIR IRON

(71) Applicant: UNIL ELECTRONICS CORP., Seoul (KR)

(72) Inventor: Ok-nam Cho, Seoul (KR)

(73) Assignee: UNIL Electronics Corp., Seoul (KR)

( * ) Notice: Subject to any disclaimer, the term of this patent is extended or adjusted under 35 U.S.C. 154(b) by 220 days.

(21) Appl. No.: 14/874,579

(22) Filed: Oct. 5, 2015

(65) Prior Publication Data

US 2016/0374445 A1 Dec. 29, 2016

(30) Foreign Application Priority Data

Jun. 26, 2015 (KR) ..... 10-2015-0091094

(51) Int. Cl.
*A45D 1/04* (2006.01)
*A45D 1/10* (2006.01)

(52) U.S. Cl.
CPC ..... *A45D 1/04* (2013.01); *A45D 1/10* (2013.01)

(58) Field of Classification Search
CPC ... A45D 1/10; A45D 1/04; A45D 1/06; A45D 1/16; A45D 1/14
USPC ..... 132/237–239, 241, 226, 227, 229, 232, 132/233, 234
See application file for complete search history.

(56) References Cited

U.S. PATENT DOCUMENTS 4,604,514 A * 8/1986 Thaler ..... A45D 1/04 132/232
4,829,156 A * 5/1989 Thompson ..... A45D 1/04 132/232
2011/0180096 A1* 7/2011 Palermo ..... A45D 1/04 132/232
2012/0145180 A1* 6/2012 Rong ..... A45D 1/10 132/227
2014/0261526 A1* 9/2014 Moll ..... A45D 2/2414 132/229

* cited by examiner

*Primary Examiner* — Todd E Manahan
*Assistant Examiner* — Brianne Kalach
(74) *Attorney, Agent, or Firm* — Sughrue Mion, PLLC

(57) ABSTRACT

A hair iron of the present invention includes a grip; a body combined with the grip, the body being provided with a switch that controls a current supply; a heating part combined with the body, the heating part generating heat by an operation of the switch; and a clip rotatably combined with the body by using a locking unit, the clip making contact with a surface of the heating part, wherein a manipulator is rotatably provided on a portion at which the body is combined with the heating part so that the locking unit of the clip can be selectively combined with the manipulator, thereby enabling lock/release of the clip relative to the body, and a control button is provided on a portion at which the grip and the body are combined, so that a rotation of the grip rotatably provided on the body is determined by an operation of the control button.

7 Claims, 9 Drawing Sheets

HAIR IRON

BACKGROUND OF THE INVENTION

Field of the Invention

The present invention generally relates to a hair iron. More particularly, the present invention relates to a hair iron that is capable of selectively combining or releasing a clip with or from a heating part and can ensure a diversity of hair curling styles and improve manipulation of a hair iron by enabling a handle to be selectively rotated from a body.

Description of the Related Art

Generally, instruments for hair care and styling may be categorized into three categories: a hair dryer, a hair brush, and a hair iron.

A hair dryer is used to dry hair by applying high heat generated by a heater to the hair. A hair brush is used to comb and style hair, and a hair iron is used to set a hair in curled or waved style by using a heat source.

Among the instruments for the hair care and styling, as illustrated in FIG. 11, a conventional bar type hair iron is comprised of a grip 51 having a power supply part, a heating body 53 integrally combined with the grip 51, the heating body 53 having a heater for generating heat, and a hair clip 55 installed to flexibly enable its rotation with reference to the heating body 53 and integrally provided with a manipulating handle 55*a* stably securing hair with reference to the heating body 53 during hair setting.

Though the foregoing conventional bar type hair iron can utilize the hair clip 55 during curling or waving, the hair clip 55 cannot be selectively combined with or released from the heating body 53. Accordingly, there is choice between the independent use of the heating body 53 and the use of the combined heating body 53 and clip 55, so the diversity of possible hair styles produced thereby is decreased.

The foregoing is intended merely to aid in the understanding of the background of the present invention, and is not intended to mean that the present invention falls within the purview of the related art that is already known to those skilled in the art.

DOCUMENTS OF RELATED ART (Patent Document 1) Korean Patent No. 10-0499806 (Registered on Jun. 28, 2005); and (Patent Document 2) Korean Patent No. 10-0539586 (Registered on Dec. 22, 2005)

SUMMARY OF THE INVENTION

To address the conventional issues, the present invention is intended to provide a hair iron that is configured to enable a clip to be combined with or released from a heating part.

The present invention is also intended to provide a hair iron that is configured to increase the convenience of its manipulation in achieving hair curling by enabling a grip to be selectively rotated with reference to a body thus partially rotating the heating part and the clip by using a grip.

In order to achieve the above objects, according to one aspect of the present invention, there is provided a hair iron including: a grip; a body combined with the grip, the body being provided with a switch that controls a current supply; a heating part combined with the body, the heating part generating heat by an operation of the switch; and a clip rotatably combined with the body by using a locking unit, the clip making contact with a surface of the heating part, wherein a manipulator is rotatably provided on a portion at which the body is combined with the heating part so that the locking unit of the clip can be selectively combined with the manipulator, thereby enabling lock/release of the clip relative to the body, and a control button is provided on a portion at which the grip and the body are combined, so that a rotation of the grip rotatably provided on the body is determined by an operation of the control button.

According to the present invention, the manipulator may include: a first guide having a first protrusion on an outer circumference of the manipulator, the first guide being combined with the heating part; and a second guide having a second protrusion on an outer circumference of the manipulator, the second guide being rotatably provided in contact with the first guide; and a locking unit, which includes: a first groove provided at a first side of an inner circumference of the locking unit so that the first protrusion fits into the first groove; and a stop rib provided along an edge of a second side of the inner circumference of the locking unit, wherein when the second protrusion is rotated and meets the stop rib, the second protrusion is caught by the stop rib, so that the manipulator and the locking unit are combined together, whereas when the second protrusion is rotated and released from the stop rib, the locked condition is released, so that the locking unit is released from the manipulator.

According to the present invention, the manipulator may include: a first guide having a first protrusion on an outer circumference of the manipulator, the first guide being combined with the heating part; a second guide having a second protrusion on an outer circumference of the manipulator, the second guide rotatably provided in contact with the first guide; and a locking unit, which includes: a first groove provided at a first side of an inner circumference of the locking unit so that the first protrusion fits into the first groove; and a stop rib provided along an edge of a second side of the inner circumference of the locking unit, with a second groove provided between the first groove and the stop rib, and with a third groove provided on the stop rib at a position corresponding to the first groove, and wherein when the first protrusion and the second protrusion of the manipulator are linearly arranged and are fitted into the first groove and the third groove of the locking unit respectively, and the second guide is rotated, the second protrusion is inserted into the second groove, so that the locking unit is combined with the manipulator.

According to the present invention, with the grip rotatably combined with the body, a first end of the grip may be provided with a locking recess, so that a locking member provided in the body, which operates in conjunction with a control switch of the control button, is selectively inserted into the locking recess, thereby enabling or disabling rotation of the grip.

According to the present invention, the body may be provided with a control button seat having a first guide hole on an upper portion thereof, and a stopper provided on a rear part of a bottom of the first guide hole, wherein with an upper part of the control switch being exposed to the control button seat, a lower part of the control switch may pass through the first guide hole so that the control switch can move in the first guide hole, and the control switch may operate in conjunction with the locking member provided at the lower part of the control switch; the locking member may be provided with a second guide hole that receives the lower part of the control switch, and a first side of the locking member may be provided with a locking jaw inserted into the locking recess of the grip, while a second side of the locking member may be provided with an elastic member supported by the stopper, so that the locking member is elastically supported toward the locking recess.

According to the present invention, a plate spring having a bent portion may be provided at a bottom of the control switch so that the control switch operates in conjunction with the plate spring, and whether the locking member is elastically supported by the elastic member may depend on whether the bent portion is caught by the stopper.

According to the present invention, the manipulator may be provided with a stop spring at a location between the first guide and the body, the stop spring operating in conjunction with the first guide, so that when the bent portion of the stop spring is caught in a recess provided at an end of the body by a rotation of the first guide, the first guide stops the rotation thereof.

As described above, the present invention provides a hair iron including: a grip; a body combined with the grip, the body being provided with a switch that controls a current supply; a heating part combined with the body, the heating part generating heat by an operation of the switch; and a clip rotatably combined with the body by using a locking unit, the clip making contact with a surface of the heating part, wherein a manipulator is rotatably provided on a portion at which the body is combined with the heating part so that the locking unit of the clip can be selectively combined with the manipulator, thereby enabling selective combination or separation of the heating part and the clip. Accordingly, the present invention is advantageous in that the heating part alone or both of the heating part and the clip can be used, thereby giving the effect of enabling various hair styles.

In addition, the hair iron of the present invention is advantageous in that it provides increased convenience in operating the hair iron for the sake of hair curling by providing the body with the rotatable grip so that the heating part and the clip can be slightly rotated by hand.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
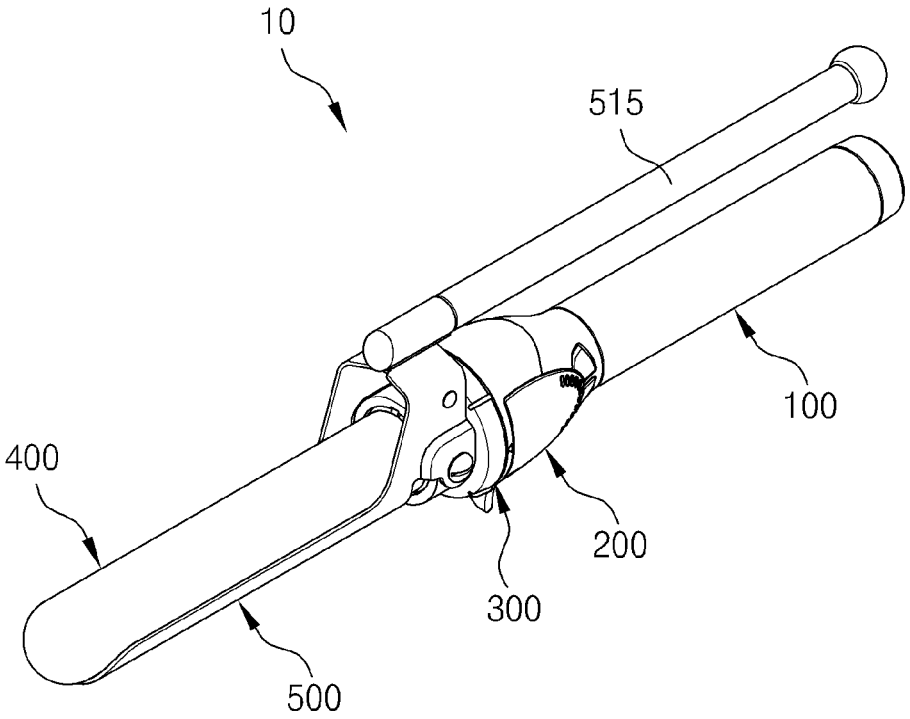
FIG. 1 is a perspective view of a hair iron of the present invention.

Reference will now be made in greater detail to an exemplary embodiment of the invention with reference to the accompanying drawings.

Wherever possible, the same reference numerals will be used throughout the drawings and the description to refer to the same or like elements or parts. In the following description, it is to be noted that, when the functions of conventional elements and the detailed description of elements related with the present invention may make the gist of the present invention unclear, a detailed description of those elements will be omitted.

Words of degree, such as "about", "substantially", and the like are used herein in the sense of "at, or nearly at, when given the manufacturing, design, and material tolerances inherent in the stated circumstances", and are used to prevent the unscrupulous infringer from unfairly taking advantage of the invention disclosure where exact or absolute figures are stated as an aid to understanding the invention.

Figure 2:
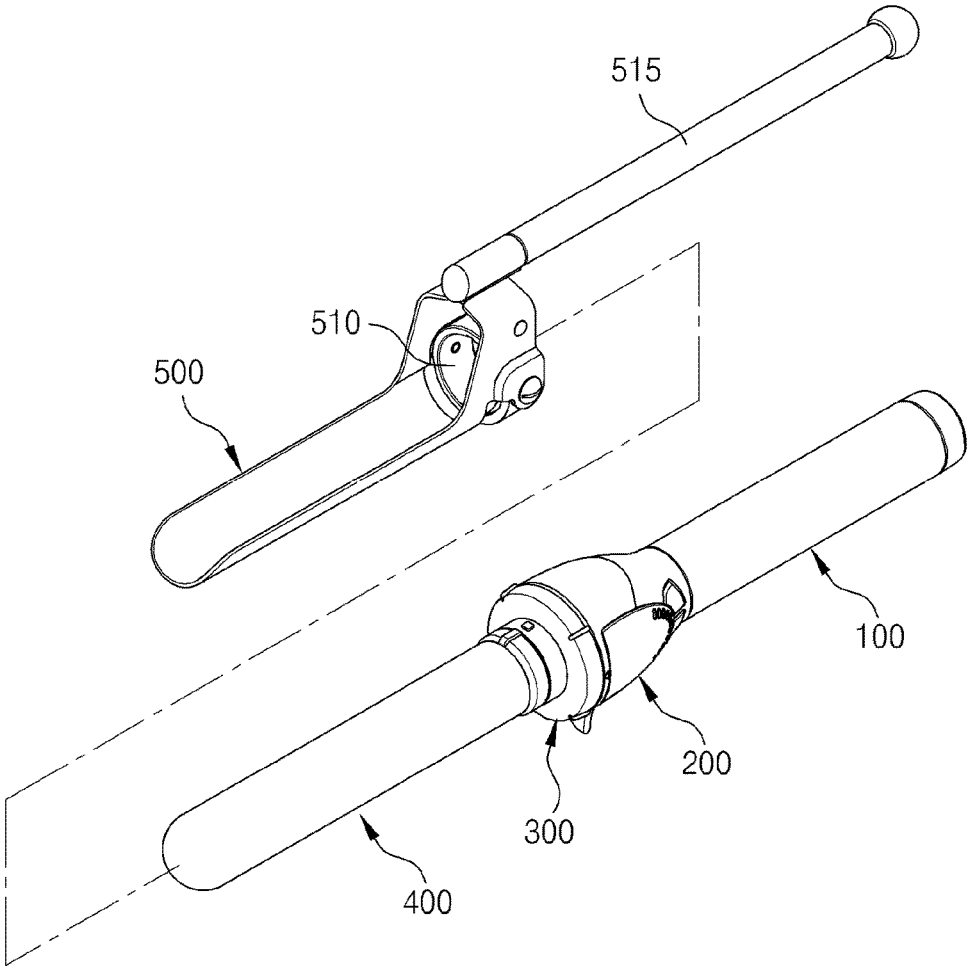
FIG. 2 is an exploded perspective view of the hair iron of the present invention.
Figure 3:
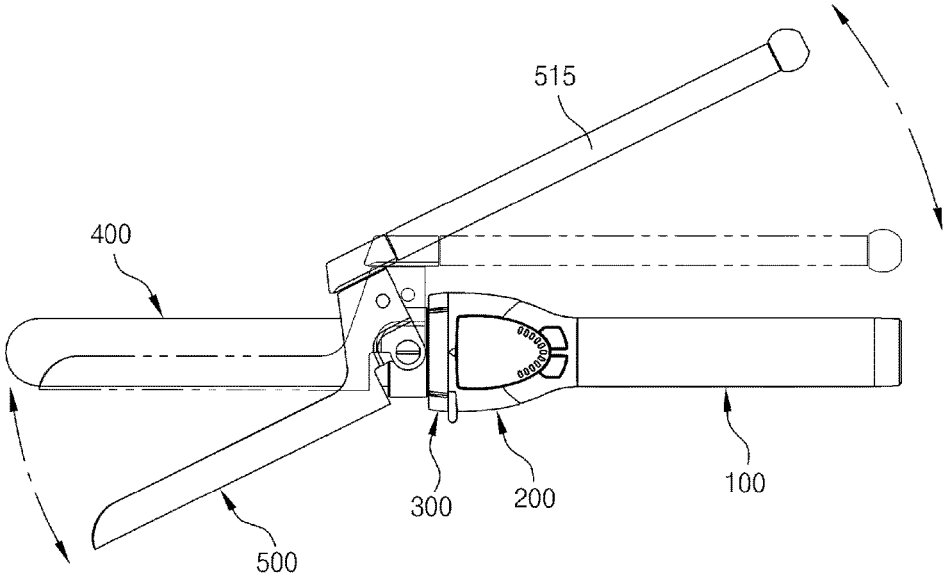
FIG. 3 is a front view of the hair iron of the present invention.
Figure 4:
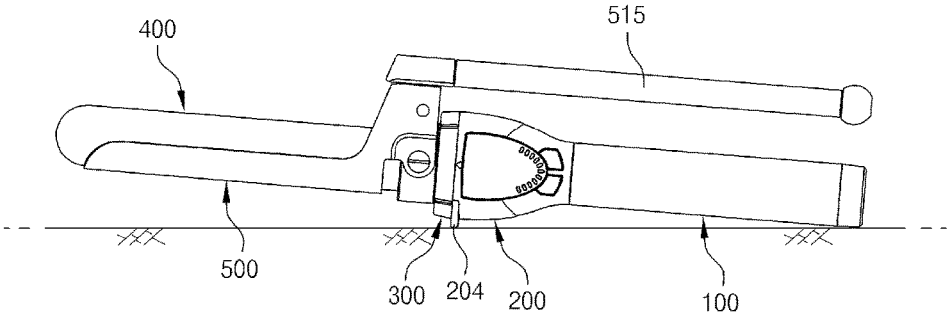
FIG. 4 is a front view illustrating a state of the hair iron of the present invention supported by a support projection.
Figure 5:
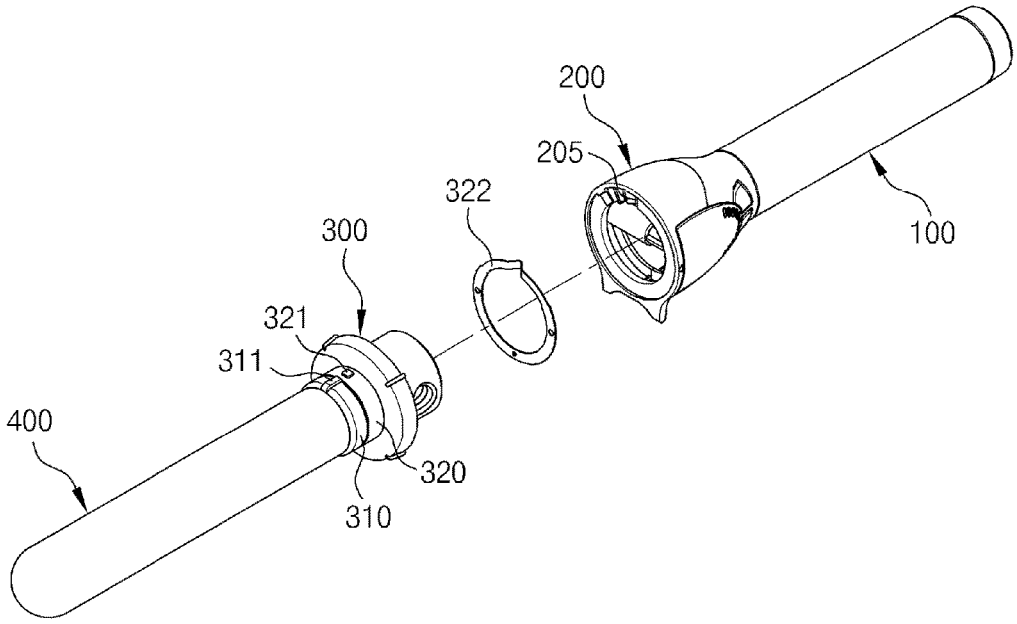
FIG. 5 is an exploded perspective view of a heating part and a body of the hair iron of the present invention.
Figure 6:
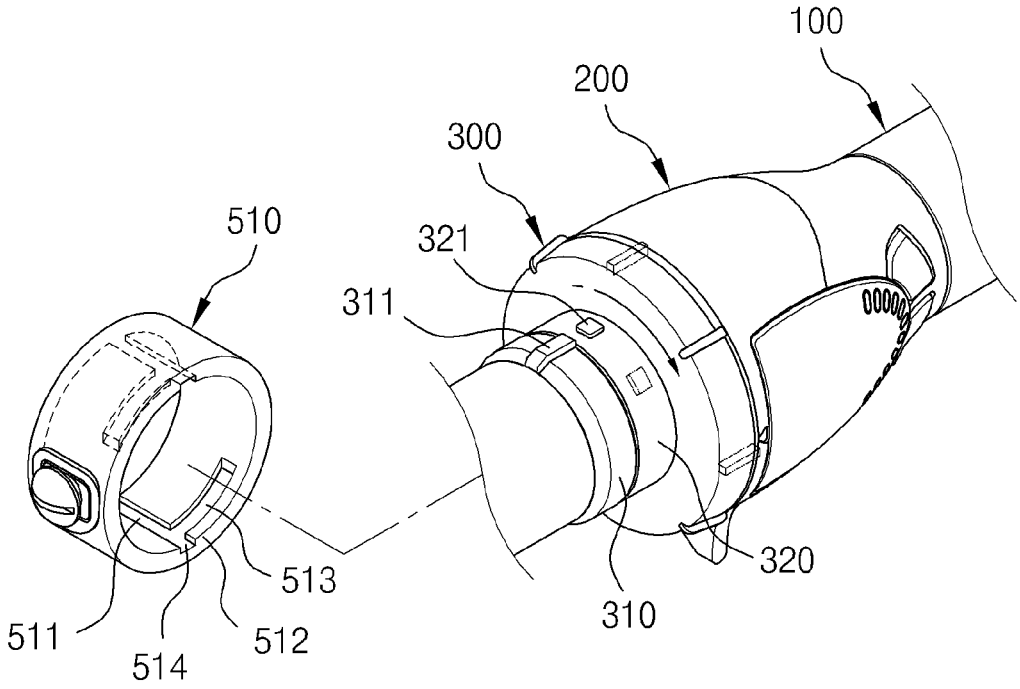
FIG. 6 is an exploded perspective view of a combined state of a manipulator and a clip of the hair iron of the present invention.
Figure 7:
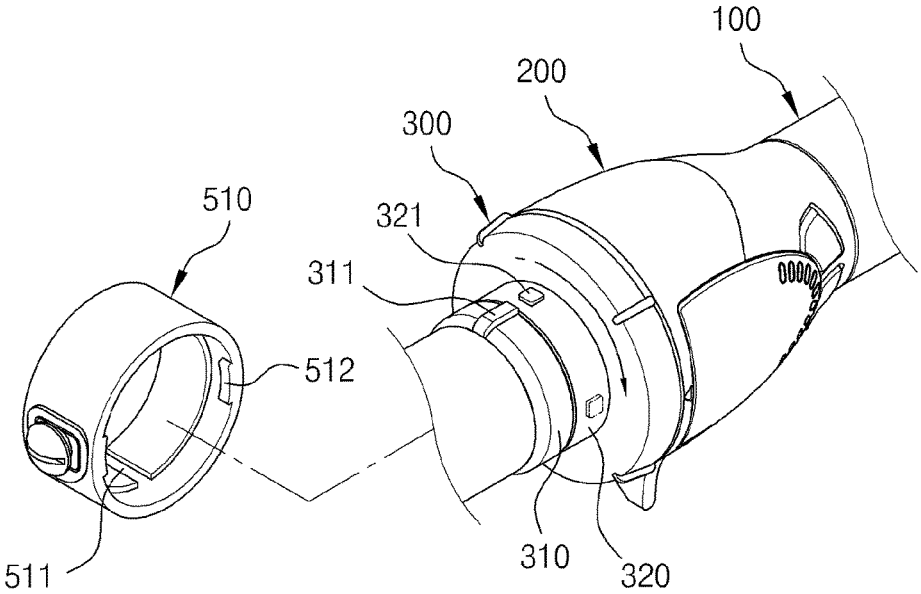
FIG. 7 is an exploded perspective view illustrating a combined state of the manipulator and the clip according to another embodiment of the present invention.
Figure 8:
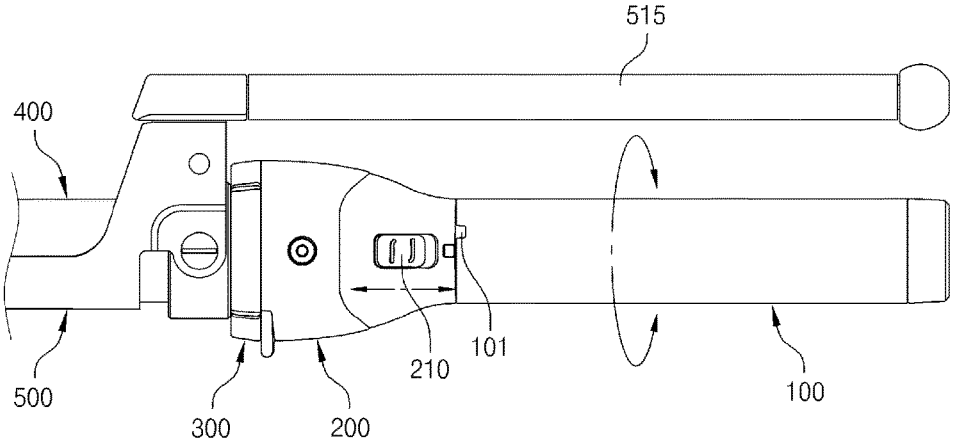
FIG. 8 is a partially enlarged front view of the hair iron of the present invention.
Figure 9A:
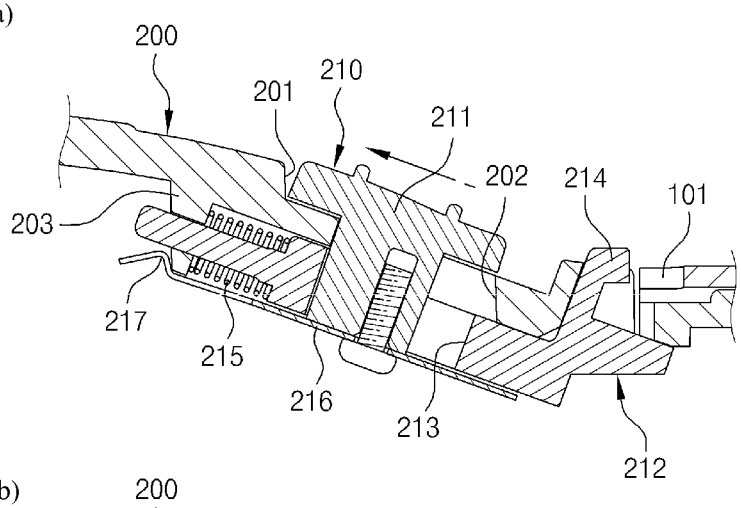
FIGS. 9(*a*) to 9(*c*) are views illustrating an operation of a manipulator of the hair iron of the present invention.
Figure 9B:
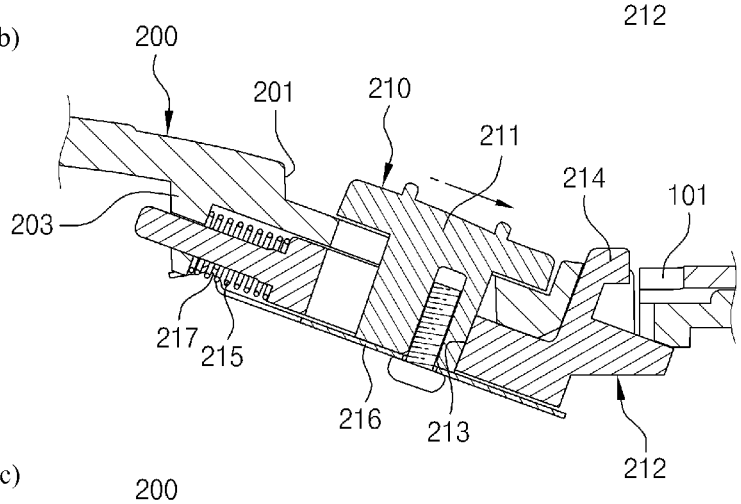
Figure 9C:
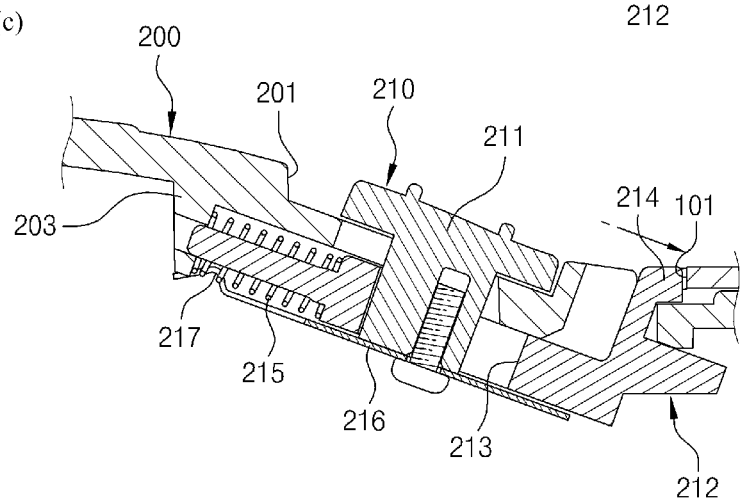
Figure 10A:
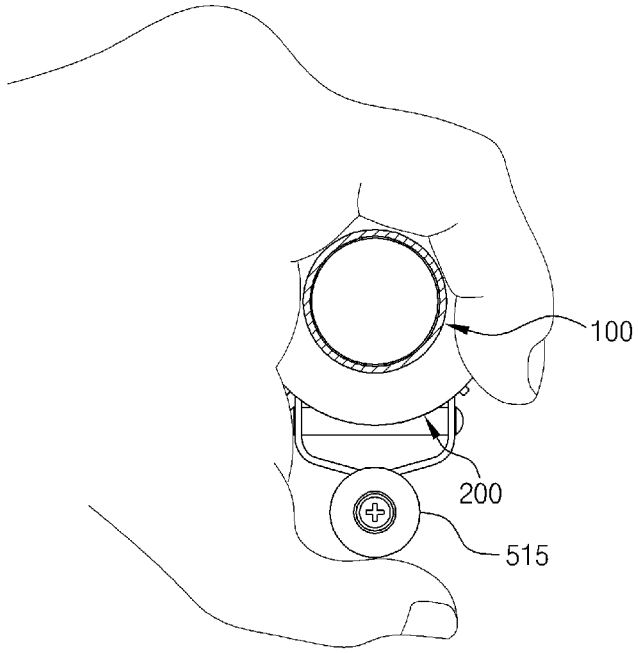
FIGS. 10(*a*) and 10(*b*) are views illustrating a state of rotating the hair iron of the present invention by a hand-grip force.
Figure 10B:
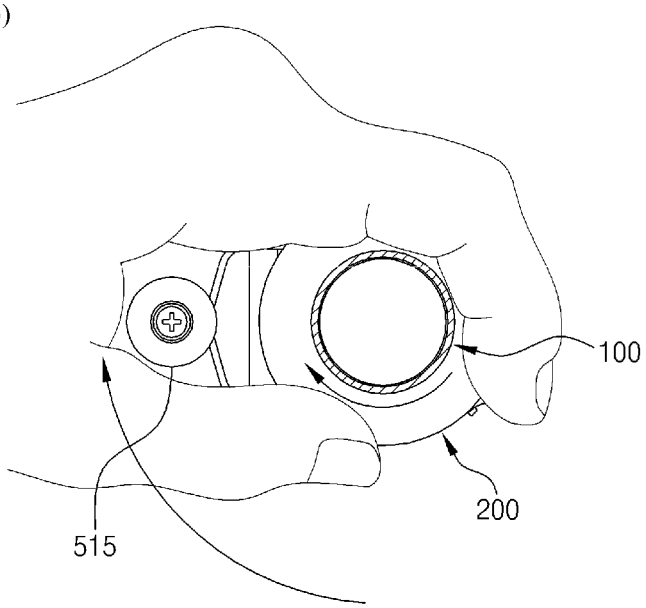
Figure 11:
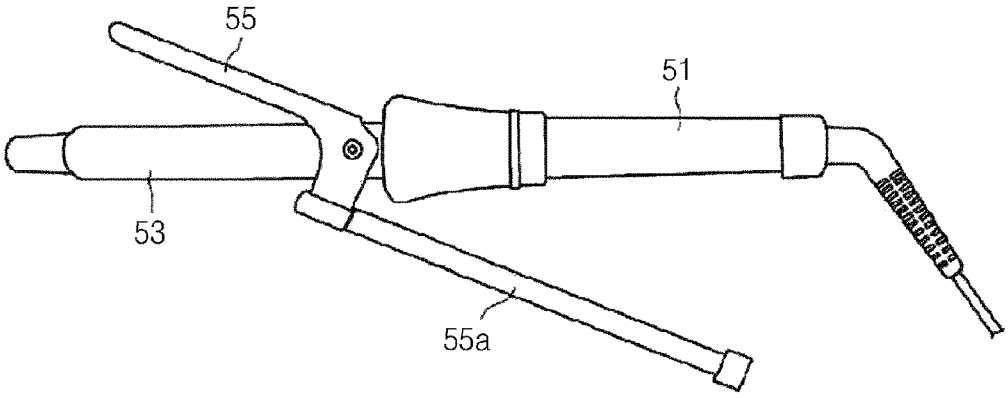
FIG. 11 is a front view of the hair iron according to the related art.

FIG. 1 is a perspective view of a hair iron of the present invention, FIG. 2 is an exploded perspective view of the hair iron of the present invention, FIG. 3 is a front view of the hair iron of the present invention, FIG. 4 is a front view illustrating a state of the hair iron of the present invention supported by a support projection, FIG. 5 is an exploded perspective view of a heating part and a body of the hair iron of the present invention, FIG. 6 is an exploded perspective view of a combined state of a manipulator and a clip of the hair iron of the present invention, FIG. 7 is an exploded perspective view illustrating a combined state of the manipulator and the clip according to another embodiment of the present invention, FIG. 8 is a partially enlarged front view of the hair iron of the present invention, FIG. 9 is a view illustrating an operation of a manipulator of the hair iron of the present invention, and FIG. 10 is a view illustrating a state of rotating the hair iron of the present invention by a hand-grip force.

First, as illustrated in FIGS. 1 to 4, the hair iron 10 of the present invention is made up of a grip 100, a body 200, a heating part 400, and a clip 500.

The body 200 is provided with a switch that controls current supply, the body 200 being combined with the grip 100.

Here, a support projection 204 is provided at the bottom of the body 200, thereby the hair iron 10 is able to be supported apart from the floor.

It is determined by a switch whether heat is generated in the heating part 400 combined with the body 200.

The clip 500 is rotatably combined with the body 200 by using a locking unit 510 and is enabled to make contact with a surface of the heating part 400, and one end of the clip 500 is combined with a handle 515 to thus operate as a pair of scissors does.

The hair iron 10 constituted in this manner generates heat by controlling a switch with the use of electric energy.

And when hair is wrapped many times by the heating part and the clip 500 presses the heating part by the scissors-like operation of the clip 500 while applying heat to the hair, the hair is curled.

For example, the heating part and the clip 500 that are combined similar to the constitution of a pair of scissors hold the hair and apply high-temperature heat, thereby changing the style of the hair.

Here, a hair straightener may have a surface that is plate-formed for grasping hair, and curling tongs may have a curved surface that only contacts hair. The hair iron 10 has a variety of applications depending on how a hairstyling is performed.

As illustrated in FIG. 6 and FIG. 7, as for the hair iron 10 constituted in the manner illustrated above, the manipulator 300 is rotatably provided on a portion at which the body 200 is combined with the heating part 400 so that the clip 500 can be selectively combined with or released from the body 200. The locking unit 510 of the clip 500 is selectively combined with the manipulator 300 so that the clip 500 can be combined with or released from the body 200.

Whether to rotate the grip 100 is selectively determined, and since the grip 100 is rotatably provided at the body 200, the grip 100 being able to be rotated by using the control button 210 provided on a portion at which the grip 100 is combined with the body 200.

First, the following is the constitution for selectively combining or separating the body 200 and the clip 500.

As illustrated in FIG. 6, the manipulator 300 according to a first embodiment is provided at the border between the heating part and the body 200, and the manipulator 300 is made up of a first guide 310, which is fixed, and a second guide 320, which is able to rotate.

The first guide 310 is in contact with the heating part and is provided with a first protrusion 311 on an outer surface of the first guide 310 in a direction of the length of the heating part 400.

The rotatable second guide 320 is provided in contact with the first guide 310 and is provided with a second protrusion 321 on an outer surface of the second guide.

The locking unit 510 is rotatably provided at the clip 500, and can be combined with or released from the manipulator 300.

To achieve this, the locking unit 510 is provided with a first groove 511 at a first side of an inner circumference of the locking unit so that the first protrusion 311 fits into the first groove 511, and the locking unit 510 is provided with a stop rib provided along an edge of a second side of an inner circumference of the locking unit. When the second protrusion 321 is rotated and meets the stop rib 512, the second protrusion of the second guide 320 is caught by the stop rib 512, so that the manipulator 300 and the locking unit 510 are combined together.

Additionally, when the second protrusion 321 is rotated and released from the stop rib 512, the locked condition is released, so that the locking unit 510 can be released from the manipulator 300.

As illustrated in FIG. 8 and FIG. 9, the manipulator 300 according to a second embodiment is provided at the border between the heating part 400 and the body 200, and the manipulator 300 is made up of a first guide 310, which is fixed, and a second guide 320, which is able to rotate.

The first guide 310 is in contact with the heating part 400 and is provided with a first protrusion 311 on an outer surface of the first guide 310 in a direction of the length of the heating part 400.

The rotatable second guide 320 is provided in contact with the first guide 310 and is provided with a second protrusion 321 on an outer surface of the second guide.

A first groove 511 is provided at a first side of an inner circumference of the locking unit 510 so that the first protrusion 311 fits into the first groove 511; a stop rib 512 is provided along an edge of a second side of the inner circumference of the locking unit 510, with a second groove 513 provided between the first groove 511 and the stop rib 512; and a third groove 514 is provided on the stop rib 512 at a position corresponding to the first groove 511.

That is, the first groove 511, the second groove 513, and the third groove 514 communicate with each other.

Due to such a constitution, when the first protrusion 311 and the second protrusion 321 of the manipulator 300 are linearly arranged and are fitted into the first groove 511 and the third groove 514 of the locking unit 510 respectively, and the second guide is rotated, the second protrusion 321 is inserted into the second groove 513, so that the locking unit 510 is combined with the manipulator 300.

In addition, when the second protrusion 321 is fitted into the third groove 514 by rotating the second protrusion 321 fitted into the second groove 513, the second protrusion 321 is released from the second groove 513, and thus the locked condition is released, thereby the locking unit 510 is released from the manipulator 300.

Here, as illustrated in FIG. 5, the manipulator 300 is provided with a stop spring 322 at a location between the first guide 310 and the body 200, the stop spring 322 operating in conjunction with the first guide 310, so that when the bent portion of the stop spring 322 is caught in a recess 205 provided at an end of the body by rotating the first guide 310, the first guide 310 stops the rotation thereof.

Through selective combination or separation of the heating part and the clip 500, the heating part alone or both of the heating part and the clip 500 can be used, which gives the effect of enabling various hair styles.

As illustrated in FIG. 9, a rotation of the grip 100 rotatably provided on the body 200 is determined by operation of a control button 210 provided on a portion at which the grip 100 and the body 200 are combined.

That is, with the grip 100 rotatably combined with the body 200, a first end of the grip 100 is provided with a locking recess 101, so that a locking member 212 provided in the body, which operates in conjunction with a control switch 211 of the control button 210, is selectively inserted into the locking recess 101, thereby enabling rotation of the grip 100 relative to the body 200.

To realize this, the body 200 is provided with a control button seat 201 having a first guide hole 202 on an upper portion thereof, and a stopper 203 is provided on a rear part of a bottom of the first guide hole 202.

An upper part of the control switch 211 is exposed to the control button seat 201, and a lower part of the control switch 211 passes through the first guide hole 202 so that the control switch 211 can move in the first guide hole 202. The control switch 211 operates in conjunction with the locking member 212 provided at the lower part of the control switch 211.

In addition, the locking member 212 is provided with a second guide hole 213 that receives the lower part of the control switch 211, and a first side of the locking member 212 is provided with a locking jaw 214 inserted into the locking recess 101 of the grip 100, while a second side of the locking member 212 is provided with an elastic member 215 supported by the stopper 203, so that the locking member 212 is elastically supported toward the locking recess 101.

a plate spring 216 having a bent portion 217 is provided at a bottom of the control switch 211 so that the control switch 211 operates in conjunction with the plate spring 216, and whether the locking member 212 is elastically supported by the elastic member 215 depends on whether the bent portion 217 is caught by the stopper 203.

The grip 100 constituted in this manner is selectively rotated as follows.

The state in which the grip 100 can rotate relative to the body 200 is kept when a locking jaw 214 of the locking member 212 is released from the locking recess 101 of the grip 100 due to the elastic member 215 compressed by locating the control switch 211 at a first side of the first guide hole 202 and the second guide hole 213 of the locking member 212.

In this case, since the bent portion 217 of the plate spring 216 integrally combined with the control switch 211 is caught in the stopper 203, the position of the control switch 211 is kept motionless.

This enables the control button 210 to be kept released from the grip 100, and thus the grip 100 can rotate at the body 200.

In addition, the control switch 211 is moved to a second side so that the grip 100 does not rotate at the body 200. In other words, the control switch 211 moves to the second side of the first guide hole 202 and the second guide hole 213.

In this case, the bent portion 217 of the plate spring 216 integrally combined with the control switch 211 is released from the stopper 203, and thus the control switch 211 is free to move.

As described in the above, the elastic member 215 pushes the locking member 212 to the second side by the control switch 211, accordingly the locking jaw 214 of the locking member 212 being stuck in the locking recess 101 of the grip 100.

This causes the control button 210 to interlock with the grip 100, so that the grip 100 does not rotate at the body 200.

Here, when the locking jaw 214 of the locking member 212 does not correspond to the locking recess 101 of the grip 100, the locking jaw 214 of the locking member 212 comes in close contact with an end of the grip 100.

Thereafter, rotating the grip 100 allows the locking jaw 214 to be elastically inserted into the locking recess 101 by the elastic member 215, and the control button 210 and the grip 100 turn back to a state in which both are combined, so that the grip 100 does not rotate at the body 200.

As described in the above, a reason why the grip 100 is rotatably provided at the body 200 as illustrated in FIG. 10, is as follows.

Since, as in the related art hair iron 10, a body 200 is integrally provided with a grip 100, so when a user of the hair iron 10 puts his/her between a heating part and a clip 500, the user rotates the hair iron 10 by using a twist of his/her wrist with the grip 100 in hand, thereby performing hair curling.

This repeated twisting of the wrist mainly contributes to pain caused in the wrist.

To prevent this pain, the present invention is intended to propose convenience in operating the hair iron for the sake of hair curling by providing the body 200 with the rotatable grip 100 so that the heating part and the clip 500 may be slightly rotated by a hand.

In other words, according to the present invention, rather than the hair iron 10 being manipulated by the twist of the wrist, it is rotated by squeezing with a hand, and thus the hair iron 10 can prevent wrist pain.

Terms or words used in this specification and claims should not be limited to a meaning in normal practice or in a common dictionary, and should be interpreted in the meaning and concept which corresponds to the spirit of the art of the present invention, based on the principle that an inventor may properly define the concept of terms in order to describe the invention in the best mode.

Accordingly, the embodiments written in the specification and the configuration illustrated in the drawings are only preferred embodiments of the present invention, and are not representative of all spirits in the art of the present invention. Thus, it should be appreciated that the present invention may be replaced with a variety of equivalents and variations as of the filing date of the present invention.

The present invention described above is not limited to the aforementioned embodiment or the accompanying drawings, and it will be apparent to those skilled in the art in the technical field to which the present invention belongs that a variety of any replacements, variations, or modifications are available within the scope of technical spirit of the present invention.

<Description of the Reference Numerals in the Drawings>

| | |
|---|---|
| 10: Hair iron | 100: Grip |
| 101: Locking recess | 200: Body |
| 201: Control button seat | 202: First guide hole |
| 203: Stopper | 204: Support projection |
| 205: Recess | 210: Control button |
| 211: Control switch | 212: Locking member |
| 213: Second guide hole | 214: Locking jaw |
| 215: Elastic member | 216: Plate spring |
| 217: Bent portion | 300: Manipulator |
| 310: First guide | 311: First protrusion |
| 320: Second guide | 321: Second protrusion |
| 322: Stop spring | 400: Heating part |
| 500: Clip | 510: Locking unit |
| 511: First groove | 512: Stop rib |
| 513: Second groove | 514: Third groove |
| 515: Handle | |

What is claimed is:

1. A hair iron comprising:

a grip;

a body combined with the grip, the body being provided with a switch that controls a current supply;

a heating part combined with the body, the heating part generating heat by an operation of the switch; and a clip rotatably combined with the body by using a locking unit, the clip making contact with a surface of the heating part, wherein a manipulator is rotatably provided on a portion at which the body is combined with the heating part so that the locking unit of the clip can be selectively combined with the manipulator, thereby enabling lock/release of the clip relative to the body, and a control button is provided on a portion at which the grip and the body are combined, so that a rotation of the grip rotatably provided on the body is determined by an operation of the control button, wherein the manipulator includes:

a first guide having a first protrusion on an outer circumference of the manipulator, the first guide being combined with the heating part; and a second guide having a second protrusion on an outer circumference of the manipulator, the second guide being rotatably provided in contact with the first guide, and wherein the locking unit includes:

a first groove provided at a first side of an inner circumference of the locking unit so that the first protrusion fits into the first groove; and a stop rib provided along an edge of a second side of the inner circumference of the locking unit, wherein when the second protrusion is rotated and meets the stop rib, the second protrusion is caught by the stop rib so that the manipulator and the locking unit are combined together, whereas when the second protrusion is rotated and released from the stop rib, the locked condition is released so that the locking unit is released from the manipulator.

2. The hair iron of claim 1, wherein with the grip rotatably combined with the body, a first end of the grip is provided with a locking recess, so that a locking member provided in the body, which operates in conjunction with a control switch of the control button, is selectively inserted into the locking recess, thereby deciding whether to rotate the grip.

3. The hair iron of claim 2, wherein the body is provided with a control button seat having a first guide hole on an upper portion thereof, and a stopper provided on a rear part of a bottom of the first guide hole, wherein with an upper part of the control switch being exposed to the control button seat, a lower part of the control switch passes through the first guide hole so that the control switch can move in the first guide hole, and the control switch operates in conjunction with the locking member provided at the lower part of the control switch, and the locking member is provided with a second guide hole that receives the lower part of the control switch, and a first side of the locking member is provided with a locking jaw inserted into the locking recess of the grip, while a second side of the locking member is provided with an elastic member supported by the stopper, so that the locking member is elastically supported toward the locking recess.

4. The hair iron of claim 3, wherein a plate spring having a bent portion is provided at a bottom of the control switch so that the control switch operates in conjunction with the plate spring, and whether the locking member is elastically supported by the elastic member depends on whether the bent portion is caught by the stopper.

5. The hair iron of claim 1, wherein the manipulator is provided with a stop spring at a location between the first guide and the body, the stop spring operating in conjunction with the first guide, so that when the bent portion of the stop spring is caught in a recess provided at an end of the body by a rotation of the first guide, the first guide stops the rotation thereof.

6. A hair iron comprising:

a grip;

a body combined with the grip, the body being provided with a switch that controls a current supply;

a heating part combined with the body, the heating part generating heat by an operation of the switch; and a clip rotatably combined with the body by using a locking unit, the clip making contact with a surface of the heating part, wherein a manipulator is rotatably provided on a portion at which the body is combined with the heating part so that the locking unit can be selectively combined with the manipulator, thereby enabling lock/release of the clip relative to the body, and a control button is provided on a portion at which the grip and the body are combined, so that a rotation of the grip rotatably provided on the body is determined by an operation of the control button, wherein the manipulator includes:

a first guide having a first protrusion on an outer circumference of the manipulator, the first guide being combined with the heating part; and a second guide having a second protrusion on an outer circumference of the manipulator, the second guide rotatably provided in contact with the first guide, and the locking unit includes:

a first groove provided at a first side of an inner circumference of the locking unit so that the first protrusion fits into the first groove; and a stop rib provided along an edge of a second side of the inner circumference of the locking unit, with a second groove provided between the first groove and the stop rib, and with a third groove provided on the stop rib at a position corresponding to the first groove, and wherein when the first protrusion and the second protrusion of the manipulator are linearly arranged and are fitted into the first groove and the third groove of the locking unit respectively, and the second guide is rotated, the second protrusion is inserted into the second groove, so that the locking unit is combined with the manipulator.

7. The hair iron of claim 6, wherein the manipulator is provided with a stop spring at a location between the first guide and the body, the stop spring operating in conjunction with the first guide, so that when the bent portion of the stop spring is caught in a recess provided at an end of the body by a rotation of the first guide, the first guide stops the rotation thereof.

* * * * *